United States Patent [19]

Frank

[11] 4,154,125

[45] May 15, 1979

[54] KNOB LOCKING AND DRAG DEVICE

[75] Inventor: Edgar H. Frank, Anaheim, Calif.

[73] Assignee: Beckman Instruments, Inc., Fullerton, Calif.

[21] Appl. No.: 813,194

[22] Filed: Jul. 5, 1977

[51] Int. Cl.[2] ..... G05G 1/10

[52] U.S. Cl. ..... 74/553; 200/321; 200/336; 248/27.1

[58] Field of Search ..... 74/553, 483 PB, 511 R, 74/504, 511 A; 248/27.1, 27.3; 16/121; 200/61.54, 321, 325, 336, 296

[56] References Cited

U.S. PATENT DOCUMENTS

| | | | |
|---|---|---|---|
| 2,161,661 | 6/1939 | Arens | 74/531 |
| 2,444,485 | 7/1948 | Aitcheson | 74/553 |
| 2,643,632 | 6/1953 | Sigmon, Jr. | 116/123 |
| 2,660,904 | 12/1953 | Hilsinger, Jr. | 74/504 |
| 2,787,353 | 4/1957 | Spraragen | 192/8 |
| 2,833,158 | 5/1958 | Damon | 74/527 X |
| 2,836,989 | 6/1958 | Schultz | 74/504 |
| 2,845,145 | 7/1958 | Lee | 74/531 X |
| 2,879,673 | 3/1959 | Passman | 74/531 |
| 2,998,733 | 9/1961 | Thompson | 74/553 |
| 3,025,931 | 3/1962 | Jones | 74/511 X |
| 3,053,110 | 9/1962 | Shalek | 74/504 |
| 3,129,400 | 4/1964 | Hartman | 74/531 X |
| 3,142,187 | 7/1964 | Kane et al. | 74/553 X |
| 3,200,366 | 8/1965 | Stuart | 248/27.1 |
| 3,236,119 | 2/1966 | Popper | 74/531 |
| 3,570,325 | 3/1971 | Kroll et al. | 74/553 X |
| 3,655,154 | 4/1972 | Orts | 248/27.1 |
| 3,855,877 | 12/1974 | Gach | 74/531 |
| 3,986,409 | 10/1976 | Tripp et al. | 74/548 |
| 4,036,079 | 7/1977 | Pratt | 74/531 |

FOREIGN PATENT DOCUMENTS

| | | | |
|---|---|---|---|
| 109562 | 4/1925 | Switzerland | 200/336 |

*Primary Examiner*—Leslie Braun

*Attorney, Agent, or Firm*—R. J. Steinmeyer; F. L. Mehlhoff; W. H. May

[57] ABSTRACT

A device for use with variable electrical components such as potentiometers to provide not only an independent means adjacent the control knob to lock the knob in a fixed position, but also to provide variable amounts of drag on the knob to enhance more precise and accurate control of the knob. The locking device is positioned between the controlled component and the control knob. The locking device can be moved to a plurality of positions adjacent the control knob to vary the amount of drag on the control knob.

6 Claims, 4 Drawing Figures

FIG. 2
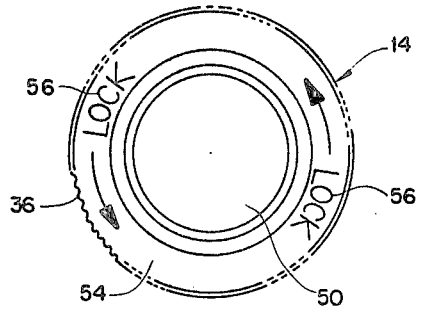
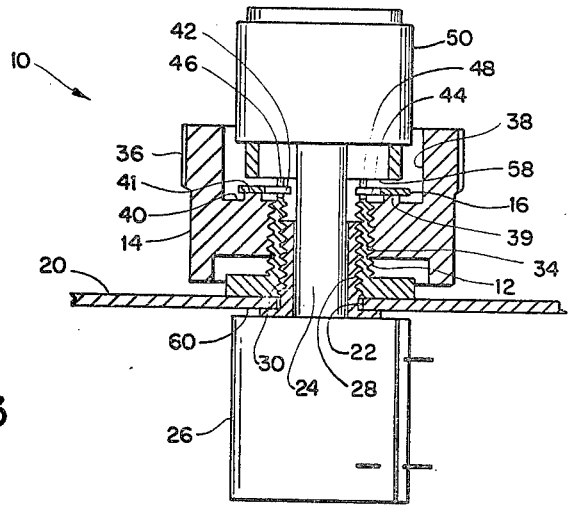
FIG. 3
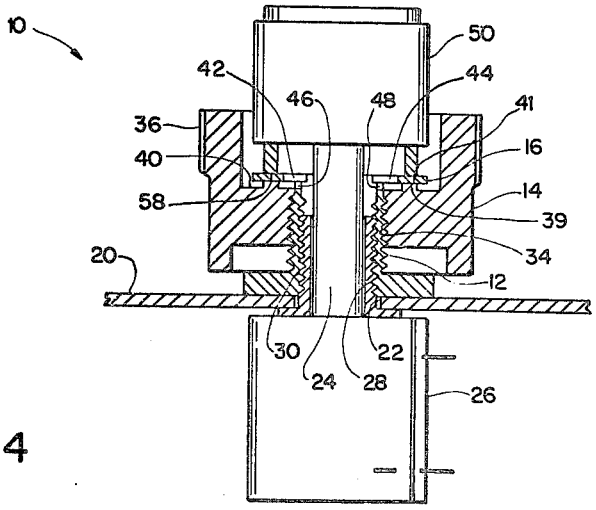
FIG. 4

KNOB LOCKING AND DRAG DEVICE

BACKGROUND OF THE INVENTION

The present invention is directed to knob locking devices and, more particularly, is directed to a knob locking device which not only provides for the complete locking of the know without affecting the position of the knob setting, but also establishes variable amounts of drag on the knob to enhance the operator's fine tuning control of the knob to adjust the electrical component.

Several prior art arrangements are known to provide a locking device to securely hold a control knob setting on a variable electronic device or component. Two pertinent prior devices are shown in the Damon U.S. Pat. No. 2,833,158 patent and the Shalek U.S. Pat. No. 3,053,110. The Damon device is only a two position arrangement wherein the locking device is either in the locked position or the unlocked position. There is no ability in the device to provide variable drag on the control knob which is desirable in many cases when an operator is precision setting the component using the control knob. If the control knob is too loose or free moving, precise positioning of the control knob is very difficult. Therefore, placing a slight amount of drag on the control knob allows an individual to enhance his precise positioning of the control knob to accurately adjust the electrical component. Further, the Damon device is unnecessarily complicated in its construction, since it utilizes at least five separate parts which must be made and assembled to constitute the locking device.

The Shalek device is also somewhat complicated in its construction, since it requires at least four components to constitute the locking device. Further, the Shalek device does not provide for a locking directly on the knob, but rather acts as a biasing means on the control shaft itself. Further, because of the unnecessary complicated use of several parts to construct not only the Shalek device, but also the Damon device, the assembly of such locking devices is more costly and time consuming. This is a considerable disadvantage with respect to the efficient and economical production of control arrangements for variable controlled electrical components or devices.

SUMMARY OF THE INVENTION

The present invention comprises a knob locking device having only three assembled pieces which provide not only for the complete locking or unlocking of the movement of the control knob without affecting the set position of the knob, but also for drag as desired on the control knob to allow a more precise and controlled movement of the knob. The present invention incorporates the use of a mounting bushing on which are positioned a holding member and a locking washer. The holding member is threadably engaged to the bushing and moves the locking washer in a longitudinal direction with respect to the control knob shaft toward and away from the knob. The holding member and locking washer are positioned between the knob and the component to be controlled. Because the holding member is threadably engaged with the bushing for movement toward and away from the control knob, the holding member can force the locking washer in direct contact with the knob with sufficient force, so that the knob is completely locked and prevented from any rotational movement. Further, the threaded engagement of the holding member with the bushing permits the holding member to vary the amount of force which may be exerted by the locking washer on the control knob.

The utilization of only three elements, the bushing, the lock washer, and the holding member, provides for a greatly simplified locking device which provides much easier assembly and greater economy in the construction of control assemblies for use with various electrical components and devices. The present invention provides for a secure and reliable locking system. There is no free play of the knob after the locking washer has been biased into tight contact against the control knob by the holding member. The present invention provides a more positive type of locking as compared to prior art devices. Continued turning of the holding member on the threads in the direction toward the control knob provides a tighter locking of the control knob to ensure that it is locked and prevented from any possible movement which may affect a critical setting of the electrical component.

BRIEF DESCRIPTION OF THE DRAWINGS

FIG. 2 is a top planar view of the present invention;

FIG. 3 is a partial sectional view of the present invention showing the locking device in the unlocked position; and FIG. 4 is a partial sectional view of the present invention similar to FIG. 3 showing the locking device in the locked position.

DETAILED DESCRIPTION OF THE INVENTION

Figure 1:
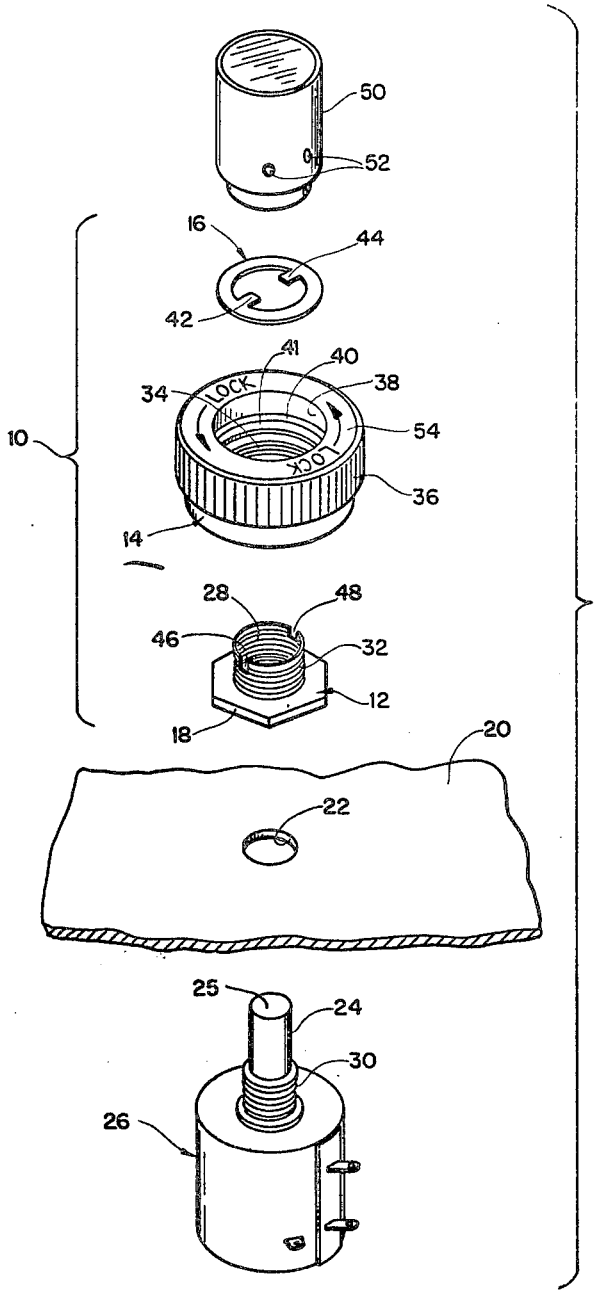
FIG. 1 is an exploded perspective view of the present invention.

The locking device 10 of the present invention is shown in FIG. 1 having a bushing 12, a holding member 14, and a locking washer 16. The bushing has a base flange 18 which is designed to mate with the control panel 20, having an aperture 22 designed to receive the shaft 24 of a variable control electrical component 26, such as a potentiometer. The bushing has internal threads 28 which are designed to receive the external threads 30 on the electrical component 26. The bushing and the electrical component are, when threaded together through the aperture 22, secured to the control panel 20. It should be noted that the bushing also has external threads 32 which are designed to receive internal threads 34 of the holding member 14. The holding member is designed to be threadably engaged with the bushing 12 to provide rotatable movement of the holding member 14 on the bushing 12, so that the holding member will also move in an axial direction along the control shaft 24 of the electrical component 26.

The holding member 14 has an outer knurled grasping surface 36 which an operator uses to rotate the holding member 14 in either a clockwise or counterclockwise direction. Located in the holding member 14 is a central recessed area 38 with a shoulder 40. Projecting from the shoulder 40 is a support ring 39 having a bearing surface 41. Positioned within the recess 38 on the bearing surface 41 is the locking washer 16 which is a circular ring having two internally directed projections 42 and 44. These projections are designed to be engaged with the slots 46 and 48 in the bushing 12. Therefore, when the bushing receives the lock washer 16 with the projections 42 and 44 in the slots 46 and 48, the locking washer cannot be rotatable with respect to either the bushing or the holding member.

As the holding member 14 moves in a longitudinal direction with respect to the control shaft 24, the locking washer is similarly moved in a longitudinal direction. Although the width of the circular bearing surface 41 is made a sufficient enough size to adequately support the locking washer 16, the width of the bearing surface 41 is kept narrow enough to provide greater pressure by the locking washer 16 against the control knob 50 as will be explained below in the operation of the present invention.

The locking washer can be made of any appropriate size to accommodate the size of the control shaft and control knob of the particular electrical component on which it is used. Where the locking washer is for use with a potentiometer 26 of the type generally shown in FIG. 1, a preferred size is approximately 0.03 to 0.06 inch thick with the inside two lugs or projections 42 and 44 being about 0.10 inch long and wide opposite each other. The locking washer can be made of aluminum, brass, copper, stainless steel or plastic.

Securely mounted to the outer end 25 of the control shaft 24 which projects through the aperture 22, the bushing 12, the holding member 14 and the locking washer 16 is a control knob 50. The control knob is securely fastened by set screw 52 to the control shaft 24 of the electrical component 26. Therefore, any rotative motion of the control knob 50 causes a similar rotative motion of the shaft 24, causing an adjustment in the electrical component 26. The outer diameter of the control knob 50 is slightly smaller than the diameter of the recess 38 in the holding member 14, so that the control knob is positioned partially within the recess 38 when the device is completely assembled.

The holding member 14 could be a molded or machined part from a plastic material. The bushing may be constructed of brass or stainless steel with the bottom flange 18 preferably having a hexagonal shape.

Located on the top surface 54 of the holding knob 14, as shown more clearly in FIG. 2, are indicia 56 showing the direction in which to rotate or turn the holding member 14 to lock the control knob 50 to prevent it from moving from a preset position.

Turning to the operation of the present invention, attention is directed to FIGS. 3 and 4. In FIG. 3, the locking device is shown in the unlocked position allowing for the free rotational movement of the control knob 50. In this orientation, showing no physical contact between the locking washer 16 and the inside face 58 of the control knob 50, the control knob is free to rotate the control shaft 24 and adjust the electrical component 26 positioned on the inside face 60 of the control panel 20.

By rotating the holding member 14 in a counterclockwise direction with respect to FIG. 2, the holding member 14 will move toward the control knob 50 in FIG. 3. The locking washer 16 which is resting on the bearing surface 41 in the recess 38 of the holding member will move longitudinally with respect to the control shaft 24 in the slots 46 and 48 of the bushing 12. The locking washer 16 will move toward the bottom surface 58 of the control knob 50. By moving the holding member 14 in a counterclockwise direction until it is turned as tight as possible, the locking washer 16 in FIG. 4 will be in tight contact with the bottom surface 58 of the control knob 50. The width of the bearing surface 41 is relatively narrow and creates a more concentrated tight force on the control knob 50 by the locking washer 16 than if the locking washer 16 were located on the shoulder 40.

Any attempt to rotate the control knob 50 will be prevented, since it is locked and will hold the precise setting desired in the electrical component. It should be noted that, since the locking washer 16 moves only in a longitudinal direction with respect to the control shaft 24 and does not rotate, its contact with the bottom surface 58 is in a nonrotative motion. Therefore, no rotative motion can be imparted to the control knob 50 which could otherwise cause undesirable movement in the control shaft and affect the desired setting. To reset the control knob the holding member 14 is turned in a clockwise direction to disengage the locking washer 16 from the control knob as shown in FIG. 3.

In some instances it is desirable to provide a slight drag force on the rotative motion of the control knob 50 rather than to completely lock the control knob 50, so that the operator's fine tuning control of the knob can be more precise. When the knob has no drag placed on it, the operator may not have the manipulative control in his fingers to provide a very precise and critical setting in the knob. Therefore, since the holding member 14 is threadably engaged with the bushing 12, it is possible to move the holding member to a plurality of positions between the completely locked position in FIG. 4 and the unlocked position in FIG. 3. Depending on the amount of drag desired, the locking washer 16 will be in either tighter or looser contact with the bottom surface 58 of the control knob 50. Of course it should be noted that when the locking washer 16 is completely out of contact with the bottom surface 58 of the control knob, there is no drag imparted upon the movement of the knob 50.

I claim:

1. A locking device assembly on a control shaft for an adjustable component, said device comprising:

a control shaft for said component;

a control knob on said shaft, rotational movement of said knob rotating said shaft to move said component, said shaft being rotatable more than 360 degrees;

a bushing mounted on said shaft between said knob and said component, said bushing being stationary with respect to rotative movement of said control shaft;

a holding member threadably engaged on said bushing, said holding member movable in a longitudinal direction with respect to said shaft toward and away from said knob; and a locking washer on said shaft between said holding member and said knob, said washer movable in said longitudinal direction along said shaft and being nonrotatable with said rotatable holding member, said holding member movable in said longitudinal direction between a first position and a second position and a plurality of positions between said first and second positions, said holding member in said first position placing said locking washer in tight contact with said knob to lock said knob, said holding member in said second position placing said locking washer out of contact with said knob to allow free movement of said knob, said holding member in each of said plurality of positions between said first and second positions providing a different amount of tightness of contact of said locking washer against said knob than in any of the other of said plurality of positions to vary the amount of drag desired on the knob to enhance fine tuning adjustment of said component.

2. A locking device as defined in claim 1, wherein said bushing has at least one slot.

3. A locking device as defined in claim 2, wherein said locking washer has an inward projection for receipt in said slot to prevent rotation of said locking washer relative to said bushing.

4. A locking device as defined in claim 1, wherein said holding member has a central recessed portion for receipt of said control knob.

5. A locking device assembly on a control shaft for an adjustable component, said device comprising:

a control shaft for said component;

a control knob on said shaft, rotational movement of said knob rotating said shaft to move said component;

a bushing mounted on said shaft between said knob and said component;

a holding member threadably engaged on said bushing, said holding member movable in a longitudinal direction with respect to said shaft toward and away from said knob;

a locking washer on said shaft between said holding member and said knob, said washer movable in said longitudinal direction along said shaft and being nonrotatable with said rotatable holding member, said holding member movable in said longitudinal direction between a first position and a second position and a plurality of positions between said first and second positions, said holding member in said first position placing said locking washer in tight contact with said knob to lock said knob, said holding member in said second position placing said locking washer out of contact with said knob to allow free movement of said knob, said holding member in each of said plurality of positions between said first and second positions providing a different amount of tightness of contact of said locking washer against said knob than in any of the other of said plurality of positions to vary the amount of drag desired on the knob to enhance fine tuning adjustment of said component; and a support ring in said holding member for receipt of said locking washer, said ring having a width smaller than the width of said washer to provide a more concentrated pressure of said washer on said control knob when said washer is in said first position.

6. A locking device assembly on a control shaft for an adjustable component, said device comprising:

a control shaft for said component;

a control knob on said shaft, rotational movement of said knob rotating said shaft to move said component;

a bushing mounted on said shaft between said knob and said component;

a holding member rotatably engaged on said bushing for movement toward and away from said knob;

a locking washer located on said bushing between said holding member and said knob, said locking washer movable by said holding member toward said knob to a completely locked position and away from said knob to a completely unlocked position, said locking washer movable to a plurality of positions between said locked and unlocked positions to set a variable amount of desired drag on said knob to enhance fine tuning adjustment of said component; and means on said locking washer and said bushing for preventing rotational movement of said locking washer as said holding member rotates to move toward and away from said knob, said rotational movement of said knob in either direction not affecting the setting of said drag on said knob.

* * * * *